US006959581B2

(12) United States Patent
Kanno

(10) Patent No.: US 6,959,581 B2
(45) Date of Patent: Nov. 1, 2005

(54) PRESS BRAKE AND RAM MOVEMENT METHOD FOR PRESS BRAKE

(75) Inventor: Kazuhiro Kanno, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 190 days.

(21) Appl. No.: 10/110,210

(22) PCT Filed: Oct. 19, 2000

(86) PCT No.: PCT/JP00/07281

§ 371 (c)(1),
(2), (4) Date: Apr. 18, 2001

(87) PCT Pub. No.: WO01/28705

PCT Pub. Date: Apr. 26, 2001

(65) Prior Publication Data

US 2005/0193798 A1 Sep. 8, 2005

(30) Foreign Application Priority Data

Oct. 20, 1999 (JP) ..... 11/298791
Oct. 25, 1999 (JP) ..... 11/302511

(51) Int. Cl.[7] ..... B21D 5/02; B30B 15/22
(52) U.S. Cl. ..... 72/389.5; 72/389.4; 72/389.6
(58) Field of Search ..... 72/389.6, 389.3–389.5, 72/453.02; 100/258 A, 258 R

(56) References Cited

U.S. PATENT DOCUMENTS 3,677,009 A 7/1972 Thatcher
4,016,742 A * 4/1977 Shiokawa ..... 72/389.5
4,291,569 A 9/1981 Breiding et al.
4,580,434 A * 4/1986 Graf ..... 72/389.5
4,797,831 A * 1/1989 Dressing et al. ..... 72/389.3
5,243,902 A 9/1993 Plazenet
5,272,643 A * 12/1993 Tokai ..... 72/389.5
5,568,766 A * 10/1996 Otremba et al. ..... 72/453.02
6,240,758 B1 * 6/2001 Nagakura ..... 72/453.02

FOREIGN PATENT DOCUMENTS

JP 08168897 7/1996
JP 08281337 10/1996
JP 10180499 7/1998

* cited by examiner

*Primary Examiner*—David Jones
(74) *Attorney, Agent, or Firm*—Greenblum & Bernstein, P.L.C.

(57) ABSTRACT

In a press brake relatively moving an upper table (5U) or a lower table (5L) upward and downward by a plurality of hydraulic cylinders (17L and 17R) so as to perform a bending work, the respective hydraulic cylinders (17L, 17R) are driven by individually controlling a pair of left and right two-way. fluid pumps and hydraulic devices (21L, 21R) provided in correspondence to the respective hydraulic cylinders (17L, 17R) The two-way fluid pumps and the respective hydraulic devices (21L, 21R) are mounted to a base plate (23) mounted to cylinder heads (18L, 18R) of the respective hydraulic cylinders (17L, 17R), and an oil tank (27) is provided in an upper side of the hydraulic devices (21L, 21R).

10 Claims, 8 Drawing Sheets

PRESS BRAKE AND RAM MOVEMENT METHOD FOR PRESS BRAKE

TECHNICAL FIELD

This invention relates to a press brake provided with a hydraulic cylinder for moving an upper table or a lower table relatively to each other upward and downward, and a ram moving method in a press brake for performing a bending work by relatively moving an upper table or a lower table upward and downward.

BACKGROUND ART

With reference to FIGS. 1 and 2, a conventionally general hydraulic press brake 201 has side plates 203L and 203R provided in a standing manner left and right, has an upper table 205U on upper front end surfaces of the side plates 203L and 203R so as to freely move upward and downward, and is provided with a lower table 205L on lower front surfaces of the side plates 203L and 203R in a fixed manner.

Further, hydraulic cylinders 207L and 207R for moving the upper table 205U upward and downward are provided in the upper front surfaces of the side plates 203L and 203R, and a hydraulic equipment 209 such as a pump, an oil tank, a control valve and the like for controlling each of the hydraulic cylinders 207L and 207R is provided in a rear portion of a center portion of the press brake 201 in a lump and is connected to each of the hydraulic cylinders 207L and 207R by a piping 211. In this case, a punch P is provided in a lower end portion of the upper table 205U so as to be freely replaced, and a die D is provided in an upper end portion of the lower table 205L so as to be freely replaced.

Accordingly, a bending work is applied to a work positioned between the punch P and the die D on the basis of a cooperation between the punch P and the die D by driving the respective hydraulic cylinders 207L and 207R according to a control of the hydraulic equipment 209 so as to move the upper table 205U upward and downward.

However, in the prior art mentioned above, since the respective cylinders 207L and 207R and the hydraulic equipment 209 are connected by the piping 211, a piping operation is required in an upper portion of the press brake 201. That is, since it is necessary to assemble the hydraulic cylinders 207L and 207R with the hydraulic equipment 209 according to an independent setup, and pipe them after mounting to a predetermined position, there is a problem that not only an operation man hour is increased, but also a risk is involved.

Further, since a long piping 211 is provided, there is a problem that the piping 211 is in danger of oil leak.

Further, since a distance between the control valve provided in the hydraulic equipment 209 and the hydraulic cylinders 207L and 207R is long, a response is bad, a pressure loss is great and a heat generation is accompanied, so that there is a problem that a controllability is bad.

Further, a working fluid in the oil tank is sucked into the hydraulic cylinders 207L and 207R by utilizing its own weight of the upper table 205U at a time of rapidly dropping, however, a temperature of the working fluid is low at a time of starting the process and a viscosity thereof is high, whereby a sufficient speed can not be obtained due to generation of suction lack or a cavitation is generated, so that there is a problem of a risk that a performance decrement is involved.

Further, a temperature of a frame is increased due to the heat generation, a heat deformation is generated in the frame, and a reduction of bending work accuracy is caused.

On the contrary, as shown in FIG. 3, for example, in a hydraulic cylinder 303 for moving an upper table 301U upward and downward corresponding to a ram in a conventional press brake, an upper cylinder chamber 305U of the hydraulic cylinder 303 is connected to a switch valve 311 by a piping 307, and a lower cylinder chamber 305L is connected to the switch valve 311 by a piping 309.

This switch valve 311 is connected to an oil tank 315 by a piping 313 and connected to the oil tank 315 via a hydraulic pump 319 by a piping 317. In this case, the hydraulic pump 319 is driven, for example, by an AC servo motor 321.

According to the structure mentioned above, in the case of moving a piston 323 upward, the hydraulic pump 319 is rotated by the AC servo motor 321, and the switch valve 311 is moved from a state shown in FIG. 3 to a left direction. Accordingly, a working fluid is discharged from the oil tank 315 by the hydraulic pump 319 so as to be supplied to the lower cylinder chamber 305L, and the working fluid in the upper cylinder chamber 305U is returned to the oil tank 315 through the switch valve 311.

On the contrary, in the case of moving the piston 323 downward, the hydraulic pump 319 is rotated by the AC servo motor 321, and the switch valve 311 is moved from the state shown in FIG. 3 to a right direction. Accordingly, since a flow of the working fluid is reversed, the working fluid discharged from the oil tank 315 is supplied to the upper cylinder chamber 305U, and the working fluid in the lower cylinder chamber 305L is returned to the oil tank 315 through the switch valve 311.

However, in the prior art mentioned above, since the working fluid in the upper cylinder chamber 305U and the working fluid in the lower cylinder chamber 305L are discharged to the oil tank 315 through the switch valve 311, a strong fluid force is applied to the switch valve 311 at a time of being discharged at a high pressure. Accordingly, there is a problem that an actuator having a great capacity is required for moving the switch valve 311, whereby a cost increase is caused and the switch valve 311 is enlarged.

Further, there is a case that the switch valve 311 vibrates due to a strong external force at a time of discharging the working fluid at a high pressure, and there is a risk that a vibration is generated in the upper table 301U corresponding to the ram. Further, as shown in FIG. 4, since a "opening degree–flow rate" property of the switch valve 311 is different between an unload time (a low pressure time) and a load time (a high pressure time), there is a risk that a motion gain of the ram is changed so as to generate the vibration. Accordingly, since the structure is made such as to make a ram speed at a time of depressure slow so as to reduce generation of the vibration, there is a problem that a productivity is deteriorated.

This invention is made by paying attention to the problems in the prior art mentioned above.

Accordingly, an object of this invention is to provide a press brake which can prevent an increase of oil temperature and can make an apparatus compact by widely reducing a capacity of an oil tank.

Another object of this invention is to provide a press brake which can reduce a shock at a time of depressure so as to prevent a vibration, and can increase a ram speed so as to improve a productivity.

Still another object of this invention is to provide a ram moving method in a press brake which can reduce a shock at a time of depressure so as to prevent a vibration, and can increase a ram speed so as to improve a productivity.

DISCLOSURE OF THE INVENTION

In order to achieve the object mentioned above, according to a first aspect of the invention, there is provided a press brake comprising a plurality of hydraulic cylinders for relatively moving an upper table or a lower table upward and downward, wherein respective two-way fluid pumps provided in correspondence to the respective hydraulic cylinders are provided so as to be connected via hydraulic devices, and the respective two-way fluid pumps and the respective hydraulic devices are structured such as to be individually controlled.

In the press brake mentioned above, a bending work is performed by relatively moving the upper table or the lower table upward and downward by means of a plurality of hydraulic cylinders, however, at this time, the respective hydraulic cylinders are driven by individually controlling the two-way fluid pumps and the respective hydraulic devices which are provided in correspondence to the respective hydraulic cylinders.

Therefore, according to the present invention, since it is not necessary to employ the conventional switch valve, and it is not necessary to rotate the two-way piston pump in a state of stopping the hydraulic cylinder, it is possible to prevent an oil temperature from being increased. Accompanying with this, it is possible to widely reduce the capacity of the oil tank, and it is possible to intend to make the apparatus compact.

According to a second aspect which is dependent upon the first aspect of the invention, there is provided a press brake comprising a plurality of hydraulic cylinders for relatively moving an upper table or a lower table upward and downward, wherein respective two-way fluid pumps provided in correspondence to the respective hydraulic cylinders are provided so as to be connected via hydraulic devices, a crowing cylinder is provided in a center portion of the lower table so as to easily pass a die provided in an upper end portion of the lower table therethrough, a two-way fluid pump is provided so as to be connected via a hydraulic device in correspondence to the crowing cylinder, and the respective two-way fluid pumps and the respective hydraulic devices are structured such as to be individually controlled.

Accordingly, in this press brake, a bending work is performed by relatively moving the upper table or the lower table upward and downward by means of a plurality of hydraulic cylinders, however, at this time, the respective hydraulic cylinders are driven by individually controlling the two-way fluid pumps and the respective hydraulic devices which are provided in correspondence to the respective hydraulic cylinders. Further, the crowing cylinder provided in the lower table is also driven by individually controlling the two-way fluid pump and the hydraulic device which are provided in correspondence to the crowning cylinder.

Therefore, according to the present invention, since it is not necessary to employ the conventional switch valve, and it is not necessary to rotate the two-way piston pump in a state of stopping the hydraulic cylinder, it is possible to prevent an oil temperature from being increased. Accompanying with this, it is possible to widely reduce the capacity of the oil tank, and it is possible to intend to make the apparatus compact.

Further, since it is possible to prevent the temperature of the frame from being increased due to the heat generation produced by the increase of the oil temperature, it is possible to prevent a heat deformation from being applied to the frame. Accordingly, since it is possible to prevent an accuracy of bending work from being reduced due to the heat deformation of the frame, the accuracy of bending work is improved.

Further, since it is possible to remove a shock and a pulsation generated within the hydraulic circuit at a time of switching a pressurized fluid direction switch valve at a time when the upper table or the lower table moves upward and downward, a service life of the apparatus becomes long, and it is possible to reduce a vibration and a noise in a processing plant.

According to a third aspect which is dependent upon the first aspect or the second aspect of the invention, there is provided a press brake as recited in the first aspect or the second aspect, wherein the respective hydraulic devices connecting the respective two-way fluid pumps corresponding to the hydraulic cylinders for relatively moving the upper table or the lower table upward and downward to the respective hydraulic cylinders are provided so as to be attached to a base plate mounted to an upper portion of the respective hydraulic cylinders, and an oil tank is provided in an upper side of the hydraulic devices.

In the structure mentioned above, the respective two-way fluid pumps corresponding to a plurality of hydraulic cylinders for relatively moving the upper table or the lower table upward and downward, and the respective hydraulic devices are mounted to the base plate mounted to the upper portion of the respective hydraulic cylinders, and the oil tank is provided in the upper side of the hydraulic devices.

Therefore, according to the present invention, it is possible to make the piping short. Accordingly, it is possible to make a piping operation easy, it is possible to reduce an oil leak and it is possible to make a pressure loss small so as to improve a controllability. Further, since a distance between the hydraulic cylinder and the oil tank is short, it is easy to suck the working fluid from the oil tank at a time when the upper table or the lower table moves downward, so that it is possible to perform a rapid downward movement without generating a suction lack of the working fluid.

According to a fourth aspect of the present invention, there is provided a press brake comprising a plurality of hydraulic cylinders for moving a ram upward and downward, the press brake comprising: two-way fluid pumps respectively provided in correspondence to the plurality of hydraulic cylinders and connected to upper cylinder chambers and lower cylinder chambers of the hydraulic cylinders; a servo motor driving the respective two-way fluid pumps so as to supply a working fluid to the upper cylinder chambers or the lower cylinder chambers; a position detector detecting a vertical position of the ram; and a control apparatus controlling the servo motor, wherein the control apparatus comprises: a determination unit for determining on the basis of a signal from the position detector whether or not a bending work is finished; and an order unit giving an order to the servo motor so as to reverse rotate the servo motor for the purpose of reversing the two-way fluid pumps at a time of being determined by the determination unit that the bending work is finished.

In the structure mentioned above, the bending work is performed by operating the two-way fluid pumps provided in correspondence to the respective hydraulic cylinders by the servo motor and supplying the working fluid to one of the upper cylinder chambers and the lower cylinder chambers in the respective hydraulic cylinders so as to move the ram upward and downward. Further, when it is determined that the bending work is finished, by detecting the vertical position of the ram by means of the position detector and determining whether or not the bending work is finished by the determination unit of the control apparatus on the basis of the detected ram position, the order unit gives the order of reverse rotation to the servo motor so as to reverse rotate the servo motor and reverse rotate the two-way fluid pumps, thereby supplying the working fluid in the one cylinder chamber to another cylinder chamber so as to switch the vertical movement of the ram.

Therefore, according to the present invention, it is not necessary to employ the conventional switch valve. Accordingly, since it is possible to reduce the shock at a time of depressure, and it is possible to increase a ram speed at a time of depressure, it is possible to improve a productivity. Further, since no switch valve is provided, it is possible to prevent the conventional vibration from being generated by the switch valve. Further, since a flow rate property is not affected by the pressure, a motion gain of the ram is not changed so much, so that it is possible to prevent the vibration due to the change of the flow rate property against the pressure.

According to a fifth aspect of the invention, there is provided a ram moving method in a press brake provided with a plurality of hydraulic cylinders for moving the ram upward and downward, comprising the steps of: rotating two-way fluid pumps connected to upper cylinder chambers and lower cylinder chambers of the hydraulic cylinders by a servo motor; supplying a working fluid to one of the upper cylinder chambers and the lower cylinder chambers in the respective hydraulic cylinders so as to move the ram upward and downward; detecting a vertical position of the ram so as to determine on the basis of the detected ram position whether or not the bending work is finished; and reversing the servo motor in the case of being determined that the bending work is finished, thereby reversing the two-way fluid pump so as to supply the working fluid supplied to the one cylinder chambers to another cylinder chambers and move the ram upward and downward.

In the structure mentioned above, the bending work is performed by operating the two-way fluid pumps provided in correspondence to the respective hydraulic cylinders by the servo motor, and supplying the working fluid to one of the upper cylinder chambers and the lower cylinder chambers in the respective hydraulic cylinders so as to move the ram upward and downward. Further, the vertical motion of the ram is performed by detecting the vertical position of the ram, determining on the basis of the detected ram position whether or not the bending work is finished, and reversing the two-way fluid pumps by reversing the servo motor when it is determined that the bending work is finished, thereby supplying the working fluid in the one cylinder chambers to another cylinder chambers.

Therefore, according to the present invention, it is not necessary to employ the conventional switch valve. Accordingly, since it is possible to reduce the shock at a time of depressure and it is possible to increase the ram speed at a time of depressure, it is possible to improve the productivity. Further, since no switch valve is provided, it is possible to prevent the conventional vibration from being generated by the switch valve. Further, since a flow rate property is not affected by the pressure, a motion gain of the ram is not changed so much, so that it is possible to prevent the vibration due to the change of the flow rate property against the pressure.

BEST MODE FOR CARRYING OUT THE INVENTION

A description will be in detail given below of an embodiment according to this invention with reference to the accompanying drawings.

Figure 1:
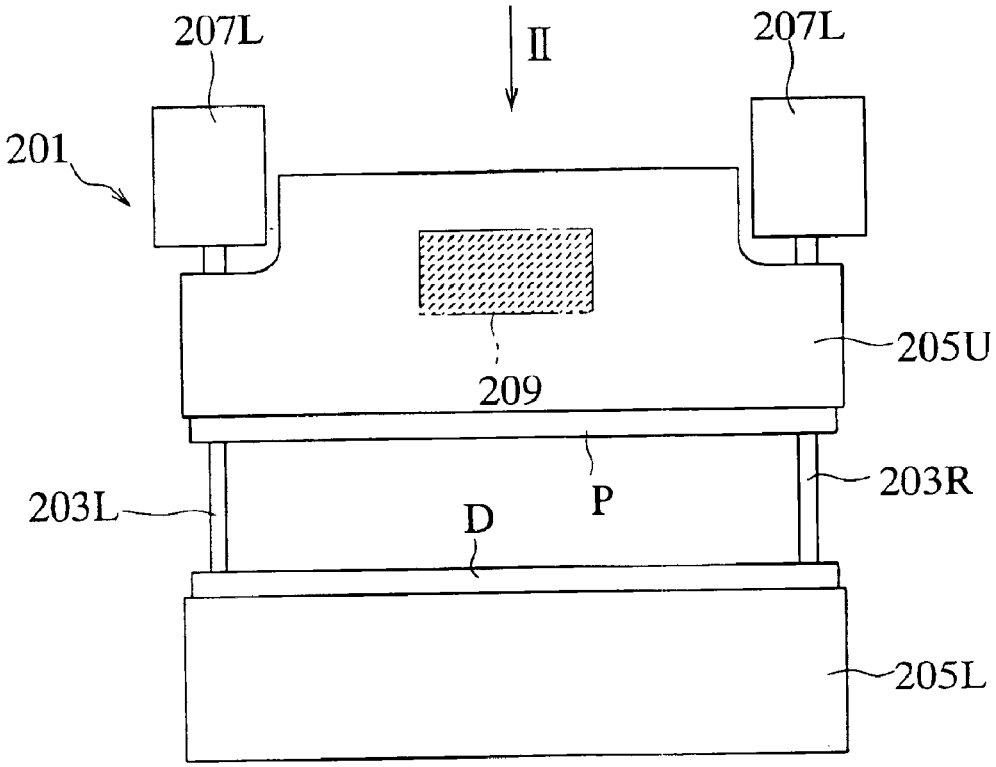
FIG. 1 is a front elevational view showing a conventional press brake.
Figure 2:
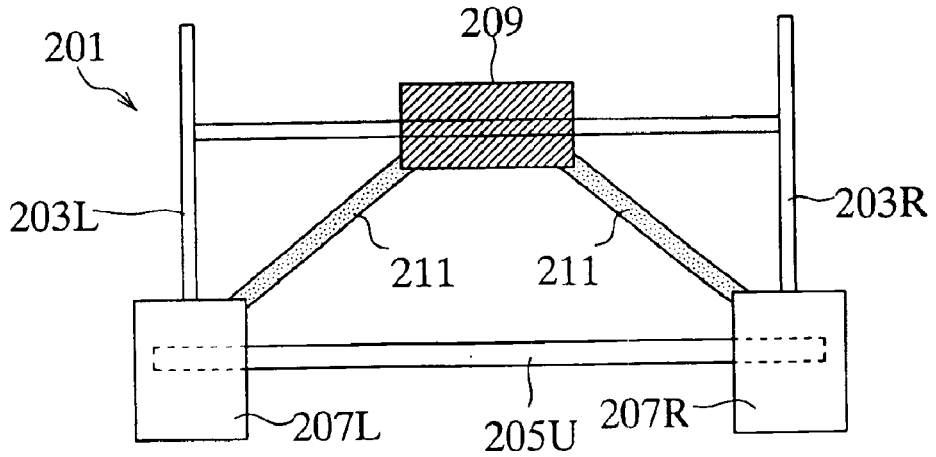
FIG. 2 is a plan view as seen from a direction II in FIG. 1.
Figure 3:
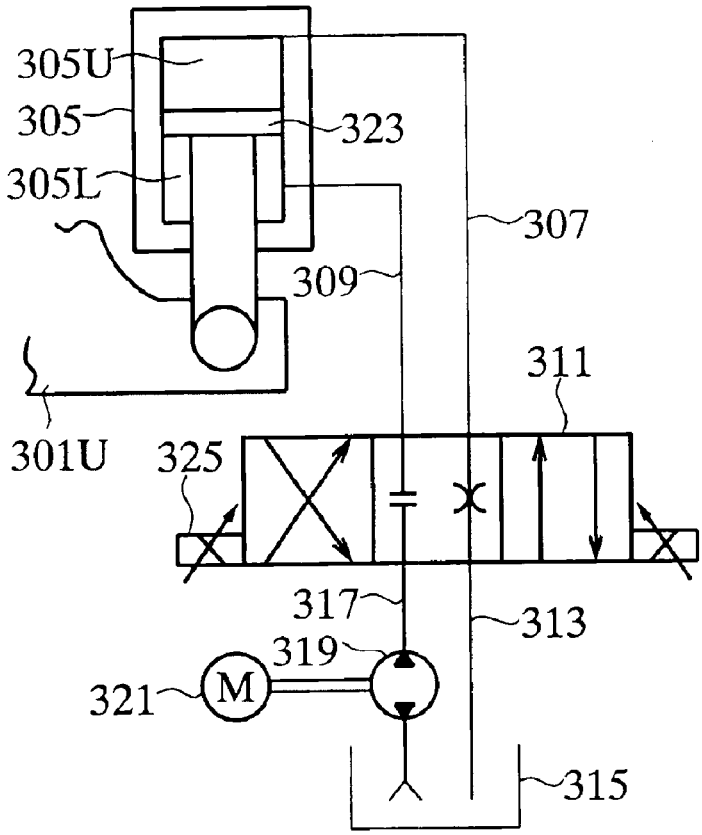
FIG. 3 is a circuit diagram showing a hydraulic circuit of a press brake according to a conventional art.
Figure 4:
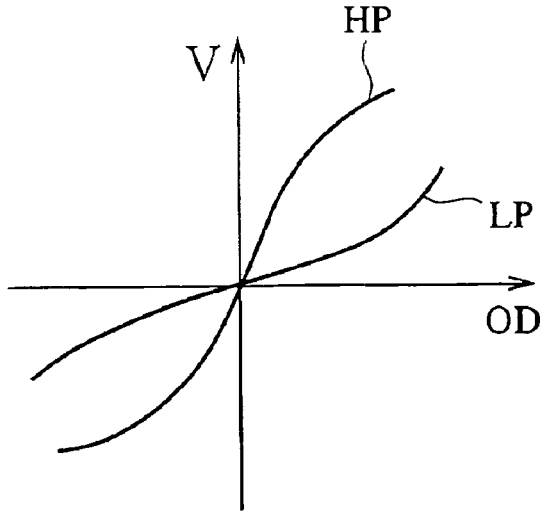
FIG. 4 is a graph showing a property of a flow rate and an opening degree with respect to a pressure of a switch valve.
Figure 5:
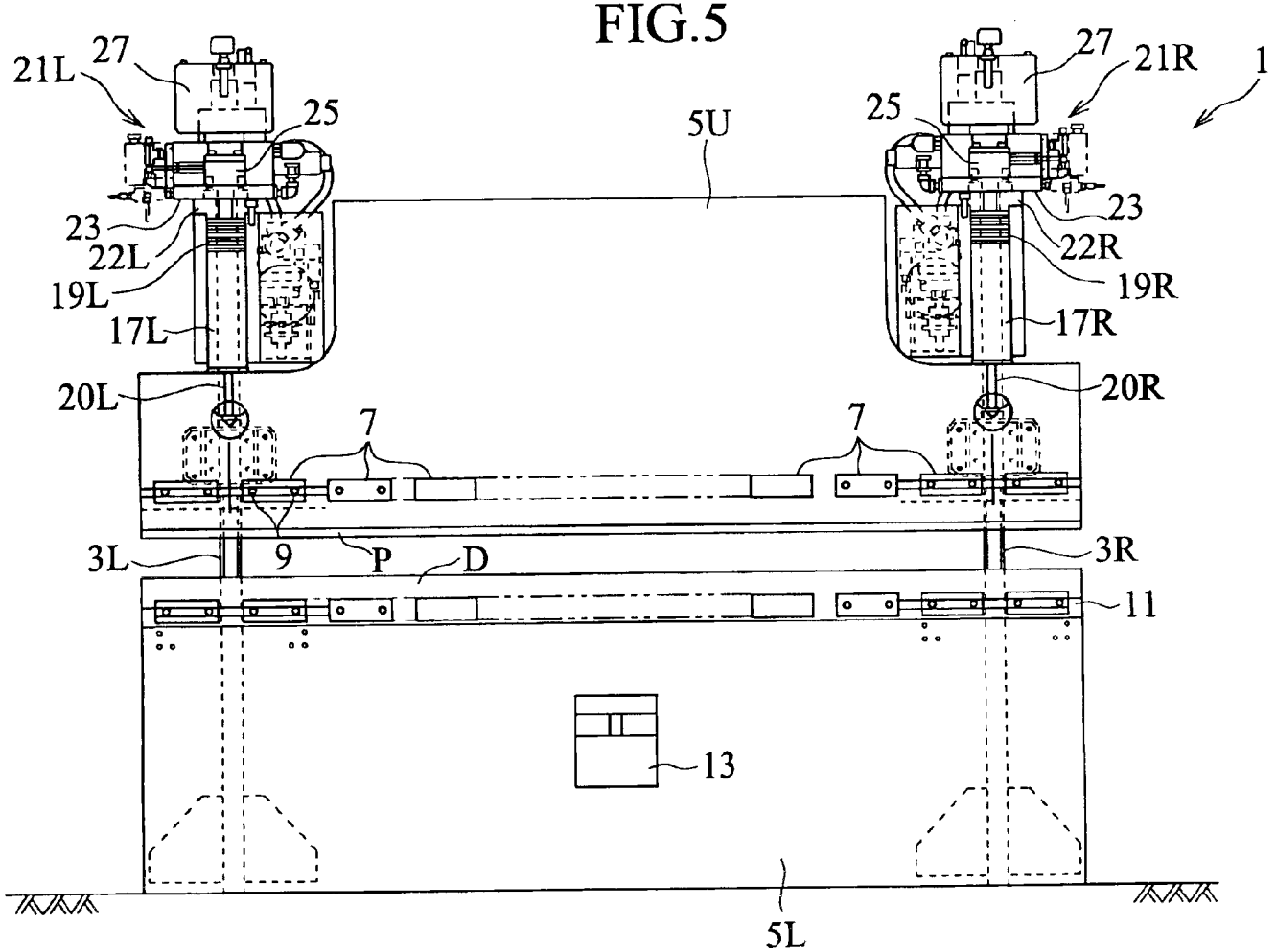
FIG. 5 is a front elevational view of a press brake according to this invention.
Figure 6:
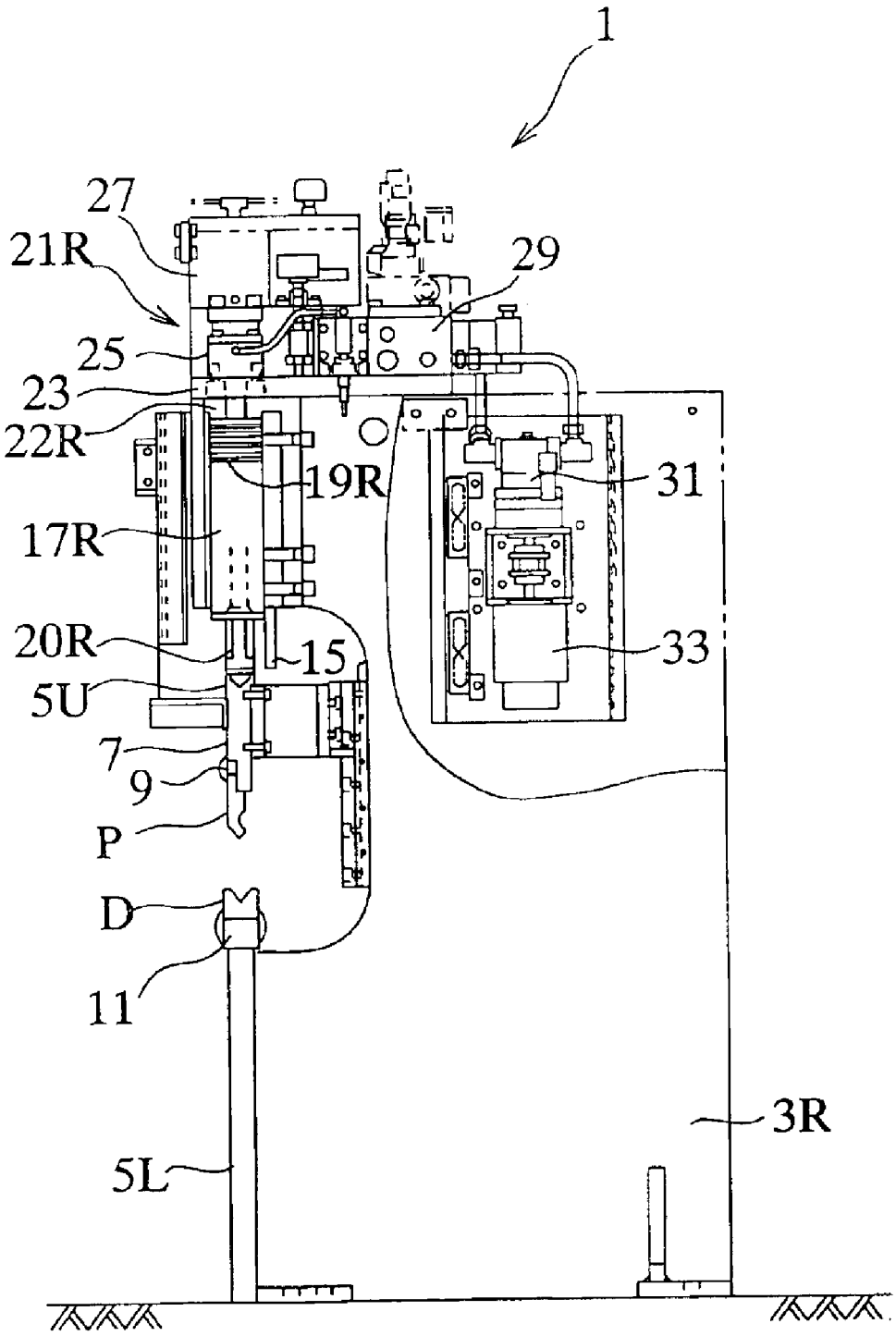
FIG. 6 is a side elevational view as seen from a right direction in FIG. 5.

In FIGS. 5 and 6, there is shown a whole of a press brake 1 according to this invention. This press brake 1 has side plates 3L and 3R provided so as to be stood in left and right sides, is provided with an upper table 5U serving as a first table on front end surfaces of upper portions in the side plates 3L and 3R so as to freely move upward and downward, and is provided with a lower table 5L serving as a second table on front surfaces of lower portions in the side plates 3L and 3R.

A punch P is provided in a lower end portion of the upper table 5U by a bolt 9 via an intermediate plate 7 so as to be freely replaced. Further, a die D is provided in an upper end portion of the lower table 5L via a die base 11 so as to be freely replaced.

Both end portions of the lower table 5L are fixed to the side plates 3L and 3R, however, a center portion thereof can be lifted upward only at a little amount, and is provided with a crowning cylinder 13 for modifying a downward displacement of the lower table 5L and the die D to an upward direction at a time of bending work so as to easily pass the die D therethrough.

In this case, a linear scale 15 for measuring a position of height of the upper table 5U is provided, and a detection of bending angle, a security and the like are performed by determining an interval with respect to the die D on the basis of the height of the punch P.

Hydraulic cylinders 17L and 17R are respectively provided in the front surfaces of the upper portions in the left and right side plates 3L and 3R, and the upper table 5U mentioned above is mounted to piston rods 20L and 20R attached to pistons 19L and 19R of the hydraulic cylinders 17L and 17R. In this case, the hydraulic cylinders 17L and 17R provided in the left and right side plates 3L and 3R, and hydraulic devices 21L and 21R controlling the hydraulic cylinders 17L and 17R include a pair of left and right linear scales, a pair of left and right two-way pumps, and a pair of left and right AC servo motors, and the same elements are independently provided in the left and right sides. Accordingly, a description will be given only of the hydraulic cylinder 17R and the hydraulic device 21R which are provided in the right side plate 3R as follows.

A base plate 23 is mounted to an upper side of a cylinder head 22R of the hydraulic cylinder 17R and an upper end surface of the side plate 3R, and the hydraulic device 21R is provided on an upper surface of the base plate 23. For example, a prefill valve 25 is provided in an upper portion of the hydraulic cylinder 17R on the upper surface of the base plate 23, and an oil tank 27 is provided on the prefill valve 25.

Further, a manifold 29 or the like is provided on the upper surface of the base plate 23 in a rearward portion (in a right direction in FIG. 6) of the prefill valve 25, and a two-way piston 31 corresponding to a two-way fluid pump and, for example, an AC servo motor 33 corresponding to a servo motor for driving the two-way piston pump 31 are provided in a rearward portion of the upper portion of the side plate 3R.

Next, a description will be given of a hydraulic circuit with respect to the hydraulic cylinder 17R with reference to FIG. 7. In this case, a description will be given of the right hydraulic cylinder 17R and the right hydraulic circuit, however, the same hydraulic cylinder 17RL and the same hydraulic circuit are provided in the left side, as mentioned above.

An upper cylinder chamber 35U of the hydraulic cylinder 17R for moving the upper table 5U corresponding to the ram upward and downward is connected to the prefill valve 25 of the hydraulic device 21R provided in the upper portion of the hydraulic cylinder 17R by a piping 37, and is further connected to the oil tank 27 provided in the upper side of the hydraulic cylinder 17R by a piping 39.

Further, the upper cylinder chamber 35U mentioned above is connected to one side of a two-way piston pump 31 capable of rotating in two directions by a piping 41. A piping 43 is connected to a middle of the piping 41, and is connected to the oil tank 27 via a check valve 45 and a suction filter 47. In this case, the two-way piston pump 31 is rotated by the AC servo motor 33.

On the contrary, a piping 49 is connected to a lower cylinder chamber 35L of the hydraulic cylinder 17R, and a counter balance valve 51 and a sequence switch valve 53 corresponding to an electromagnetic poppet valve are provided in parallel. The counter balance valve 51 and the sequence switch valve 53 are connected to another side of the two-way piston pump 31 by a piping 55. Further, the piping 55 is connected to the oil tank 27 via a check valve 57 and a suction filter 59 by a piping 61.

A throttle valve 63 and a high pressure preference type shuttle valve 65 are provided in the middle of the piping 49. A piping 67 is connected to a discharge side of the high pressure preference type shuttle valve 65, and a relief valve 69 and a piping 71 are provided in the piping 67.

According to the structure mentioned above, in the case that the working fluid is charged into the upper cylinder chamber 35U and the lower cylinder chamber 35L, the two-way piston pump 31 stops and the piston 19R rapidly moves the upper table 5U downward from a state of being at a top dead center due to its own weight of the upper table 5U and the hydraulic cylinder 17R, the piping 49 and the piping 55 are communicated by switching the sequence switch valve 53, and the two-way piston pump 31 is rotated by the AC servo motor 33.

Figure 7:
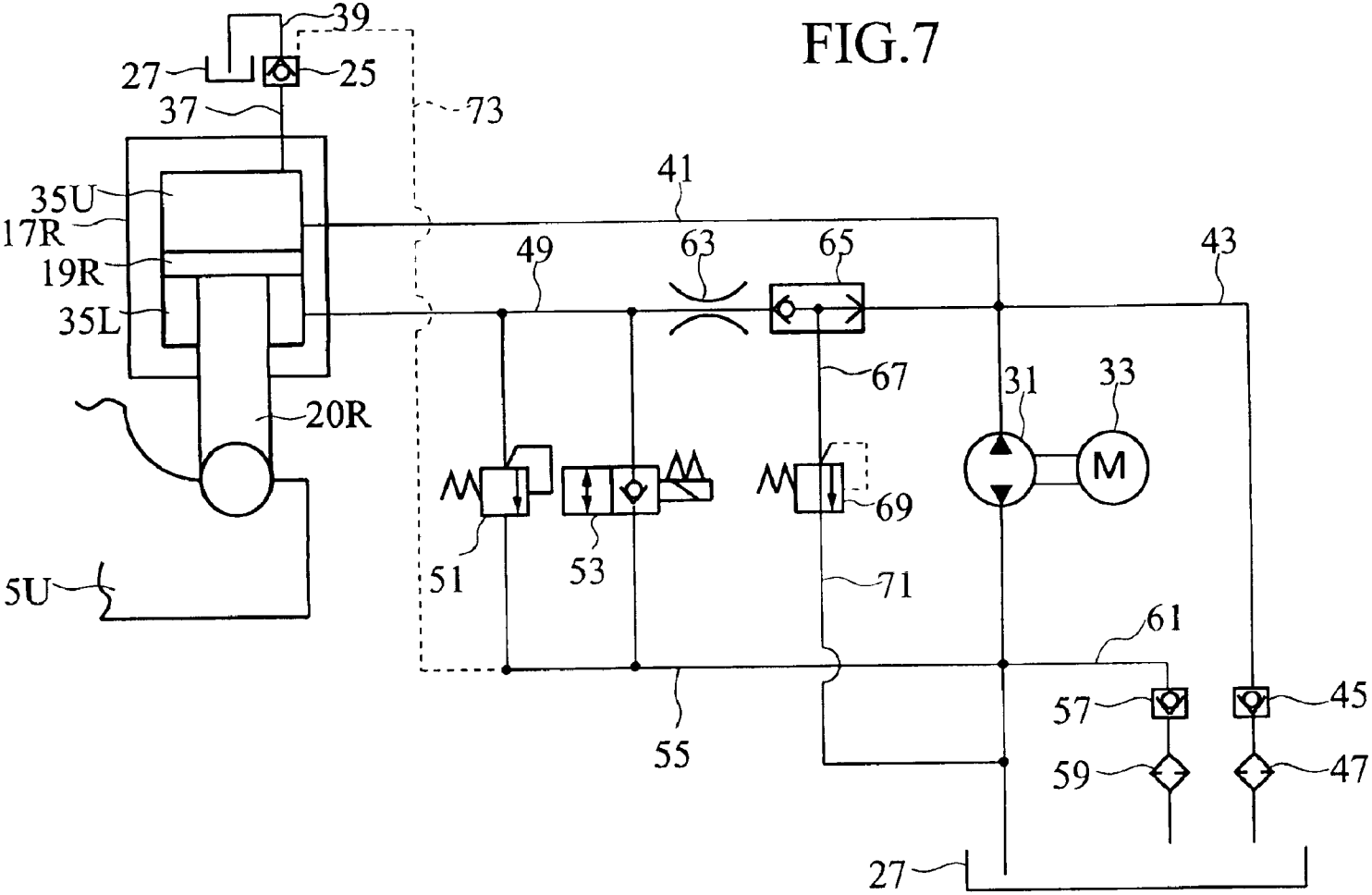
FIG. 7 is a circuit diagram showing a hydraulic circuit of a hydraulic cylinder in the press brake according to this invention.

In the case of further moving downward so as to perform the bending work, the sequence switch valve 53 is set to a state shown in FIG. 7, and the working fluid from the lower cylinder chamber 35L is charged into the upper cylinder chamber 35U of the hydraulic cylinder 17R from the piping 41 via the piping 49, the counter balance valve 51 and the piping 55 by the two-way piston pump 31. Accordingly, the piston 19R moves downward and the upper table 5U moves downward, thereby performing the bending work.

In this case, since a cross sectional area in a lower surface side of the piston 19R is smaller than an upper surface side, an amount of the working fluid discharged from the lower cylinder chamber 35L and returning to the two-way piston pump 31 is less than an amount of the working fluid charged into the upper cylinder chamber 35U, so that the working fluid is refilled from the oil tank 27 via the check valve 57.

On the contrary, in the case of moving the upper table 5U upward by the hydraulic cylinder 17R, the switch valve 53 is switched to a state shown in FIG. 7, the AC servo motor 33 is rotated in an opposite direction to that of the case mentioned above so as to reverse rotate the two-way piston pump 31, and the working fluid from the upper cylinder chamber 35U in a state in which the piston 19R moves downward is charged into the lower cylinder chamber 35L through the piping 41 and the two-way piston pump 31. Accordingly, the piston 19R moves upward and the upper table 5U moves upward.

In this case, when a pressure of the working fluid charged into the lower cylinder chamber 35L becomes higher than a predetermined value, the prefill valve 25 is opened according to a pilot signal 73, and the working fluid is discharged to the oil tank 27 from the upper cylinder chamber 35U through the prefill valve 25.

As a result of the above, since the piston 19R of the hydraulic cylinder 17R is moved upward and downward by using the two-way piston pump 31, it is not necessary to use the switch valve and the flow amount control valve which are used in the conventional art, and in a state of stopping the piston 19R, since it is not necessary to rotate the AC servo motor 33 and the two-way piston pump 31, it is possible to prevent an oil temperature from being increased. Accompanying with this, it is possible to widely reduce the capacity of the oil tank 27 (about one fourth to one fifth of the conventional one), and it is possible to make the apparatus compact and it is possible to reduce a cost.

Further, since the hydraulic device 21R such as the oil tank 27, the two-way piston pump 31, the AC servo motor 33 and the like is provided close to the upper side of the hydraulic cylinder 17R, it is possible to make the piping short, and it is possible to make a wiring operation easy. Further, it is possible to reduce an oil leak and it is possible to improve a controllability by reducing a pressure loss.

Further, since the distance between the hydraulic cylinder 17R and the oil tank 27 is short, it is easy to suck the working fluid from the oil tank 27 at a time when the upper table 5U moves downward, so that it is possible to rapidly move downward without generating a suction lack of the working fluid.

Further, since the two-way piston pump 31 is rotated by the AC servo motor 33 capable of performing a control with high precision, it is possible to control the hydraulic pressure with high precision, and it is possible to improve an accuracy of bending work.

Figure 8:
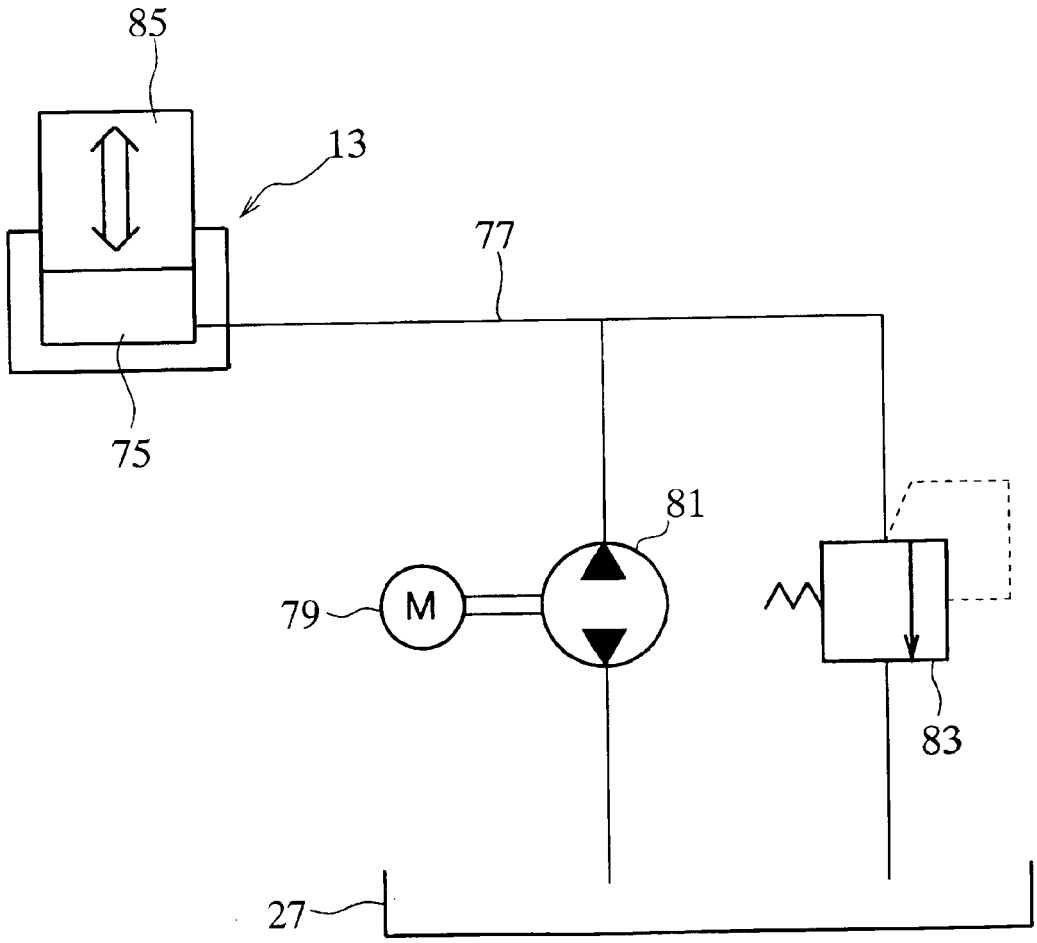
FIG. 8 is a circuit diagram showing a hydraulic circuit of a crowning cylinder in the press brake according to this invention.

FIG. 8 shows a hydraulic circuit of the crowning cylinder 13. In this hydraulic circuit, a piping 77 is connected to a lower cylinder chamber 75 of the crowning cylinder 13, and the piping 77 is connected to the oil tank 27 via a two-way piston pump 81 rotated by an AC servo motor 79. Further, the piping 77 is connected to the oil tank 27 via a relief valve 83.

According to the structure in FIG. 8, the center of the lower table 5L is lifted up by rotating the two-way piston pump 81 by the AC servo motor 79 and supplying the working fluid to the lower cylinder chamber 75 of the crowning cylinder 13 so as to move a piston 85 upward, thereby modifying pass-through of the die D. Further, in the case of moving the piston 85 down ward, the two-way piston pump 81 is reverse rotated by the AC servo motor 79, and the working fluid in the lower cylinder chamber 75 is discharged into the oil tank 27.

As a result of the above, since the piston 85 of the crowning cylinder 13 is moved upward and downward by using the two-way piston pump 81, it is not necessary to use the switch valve which is used in the conventional art, and in a state of stopping the piston 85, since it is not necessary to rotate the AC servo motor 79 and the two-way piston pump 81, it is possible to prevent an oil temperature from being increased. Accompanying with this, it is possible to widely reduce the capacity of the oil tank 27 (about one fourth to one fifth of the conventional one), and it is possible to make the apparatus compact and it is possible to reduce a cost.

Further, since the two-way piston pump 81 is rotated by the AC servo motor 79 capable of performing a control with high precision, it is possible to control the hydraulic pressure with high precision, and it is possible to correct the pass-through-straightness of the die D so as to improve an accuracy of bending work.

In FIGS. 7 and 8 mentioned above, the relief valves 69 and 83 serve as a safety valve at a time when the pressure becomes excessive.

Next, a description will be given in detail of a second embodiment according to this invention with reference to the accompanying drawings.

Figure 10:
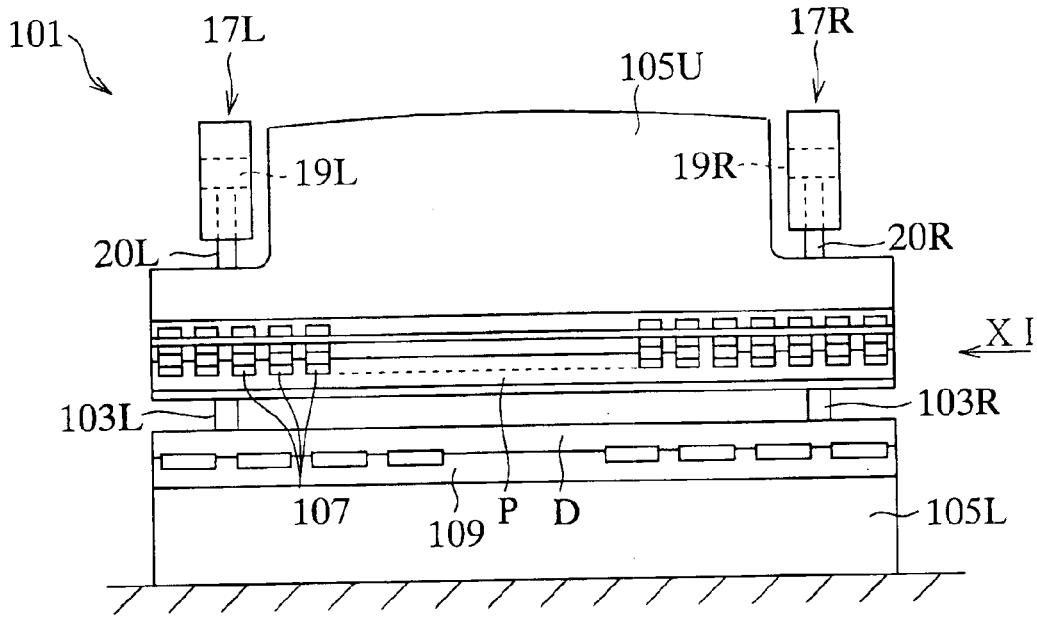
FIG. 10 is a front elevational view of the press brake according to this invention.
Figure 11:
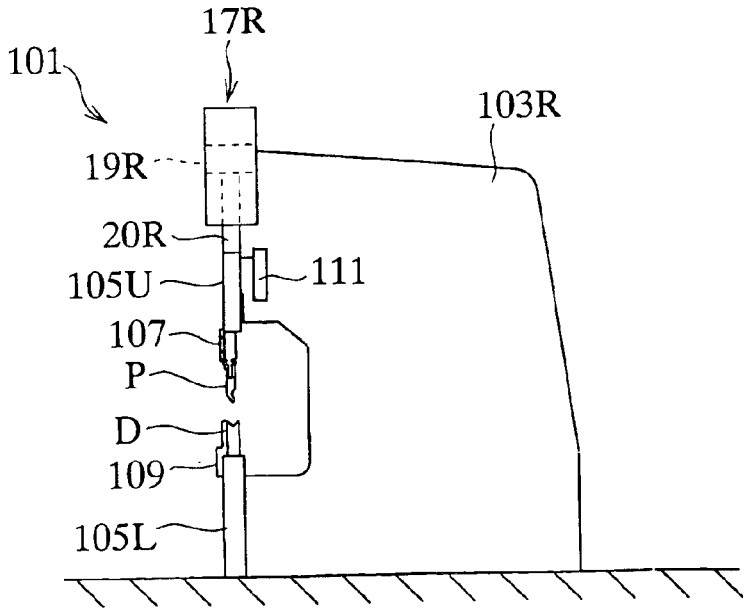
FIG. 11 is a side elevational view as seen from a direction XI in FIG. 10.

In FIGS. 10 and 11, there is shown a whole of a press brake 101 according to this invention. This press brake 101 has side plates 103L and 103R provided so as to be stood in left and right sides, has an upper table 105U corresponding to a ram on front end surfaces of upper portions in the side plates 103L and 103R so as to freely move upward and downward, and is provided with a lower table 105L on front surfaces of lower portions in the side plates 103L and 103R.

A punch P is provided in a lower end portion of the upper table 105U via an intermediate plate 107 so as to be freely replaced. Further, a die D is provided in an upper end portion of the lower table 105L so as to be freely replaced in a die base 109.

In this case, a linear scale 111 corresponding to one example of a position detector for measuring a height position of the upper table 105U is provided, and whether or not the bending work is finished, a detection of bending angle, a security and the like are performed by determining an interval with respect to the die D on the basis of the height of the punch P.

Hydraulic cylinders 17L and 17R are respectively provided in the front surfaces of the upper portions in the left and right side plates 103L and 103R, and the upper table 105U mentioned above is mounted to piston rods 20L and 20R attached to pistons 19L and 19R of the hydraulic cylinders 17L and 17R.

Next, a description will be given of a hydraulic circuit with respect to the hydraulic cylinders 17L and 17R with reference to FIG. 9. In this case, the left and right hydraulic cylinders 17L and 17R include a pair of left and right linear scales, a pair of left and right two-way pumps, and a pair of left and right AC servo motors in the same manner as the embodiment described first, and the absolutely same hydraulic circuits are independently provided in the left and right positions of the apparatus. Accordingly, a description will be given only of the hydraulic cylinder 17R and the hydraulic circuit which are provided in the right side as follows.

An upper cylinder chamber 35U of the hydraulic cylinder 17R for moving the upper table 105U corresponding to the ram upward and downward is connected to the prefill valve 25 by a piping 37, and is further connected to the oil tank 27 by a piping 39.

Further, the upper cylinder chamber 35U mentioned above is connected to one side of a two-way piston pump 31 corresponding to a two-way fluid pump capable of rotating in two directions by a piping 41. A piping 43 is connected to a middle of the piping 41, and is connected to the oil tank 27 via a check valve 45 and a suction filter 47. In this case, the two-way piston pump 31 is rotated by the AC servo motor 33 corresponding to a servo motor.

On the contrary, a piping 49 is connected to a lower cylinder chamber 35L of the hydraulic cylinder 17R, and a counter balance valve 51 and a sequence switch valve 45 corresponding to an electromagnetic poppet valve are provided in parallel. The counter balance valve 51 and the sequence switch valve 53 are connected to another side of the two-way piston pump 31 by a piping 55. Further, a piping 61 is connected to the piping 55 in the middle thereof, and this piping 61 is connected to the oil tank 27 via a check valve 57 and a suction filter 59.

Further, a throttle valve 63 and a high pressure preference type shuttle valve 65 are provided between the piping 49 and the piping 41. A piping 67 is connected to a discharge side of the high pressure preference type shuttle valve 65. A relief valve 69 is connected to the piping 67, and further a piping 71 connected to the oil tank 27 is provided.

The AC servo motor 33 rotating the two-way piston pump 31 is controlled by a control apparatus 165. The control apparatus 165 has a determination unit 169 for determining on the basis of a position signal 167 of the upper table 105U sent from the linear scale 111 mentioned above whether or not the bending work is finished, and an order unit 173 generating an order signal 171 for normal rotation or reverse rotation to the AC servo motor 33 on the basis of the determination of the determination unit 169.

According to the structure mentioned above, in the case that the working fluid is charged into the upper cylinder chamber 35U and the lower cylinder chamber 35L, the two-way piston pump 31 stops and the piston 19R rapidly moves the upper table 105U downward from a state of being at a top dead center due to its own weight of the upper table 105U and the hydraulic cylinder 17R, the piping 49 and the piping 55 are communicated by switching the sequence switch valve 53, and the two-way piston pump 31 is rotated by the AC servo motor 33.

Figure 9:
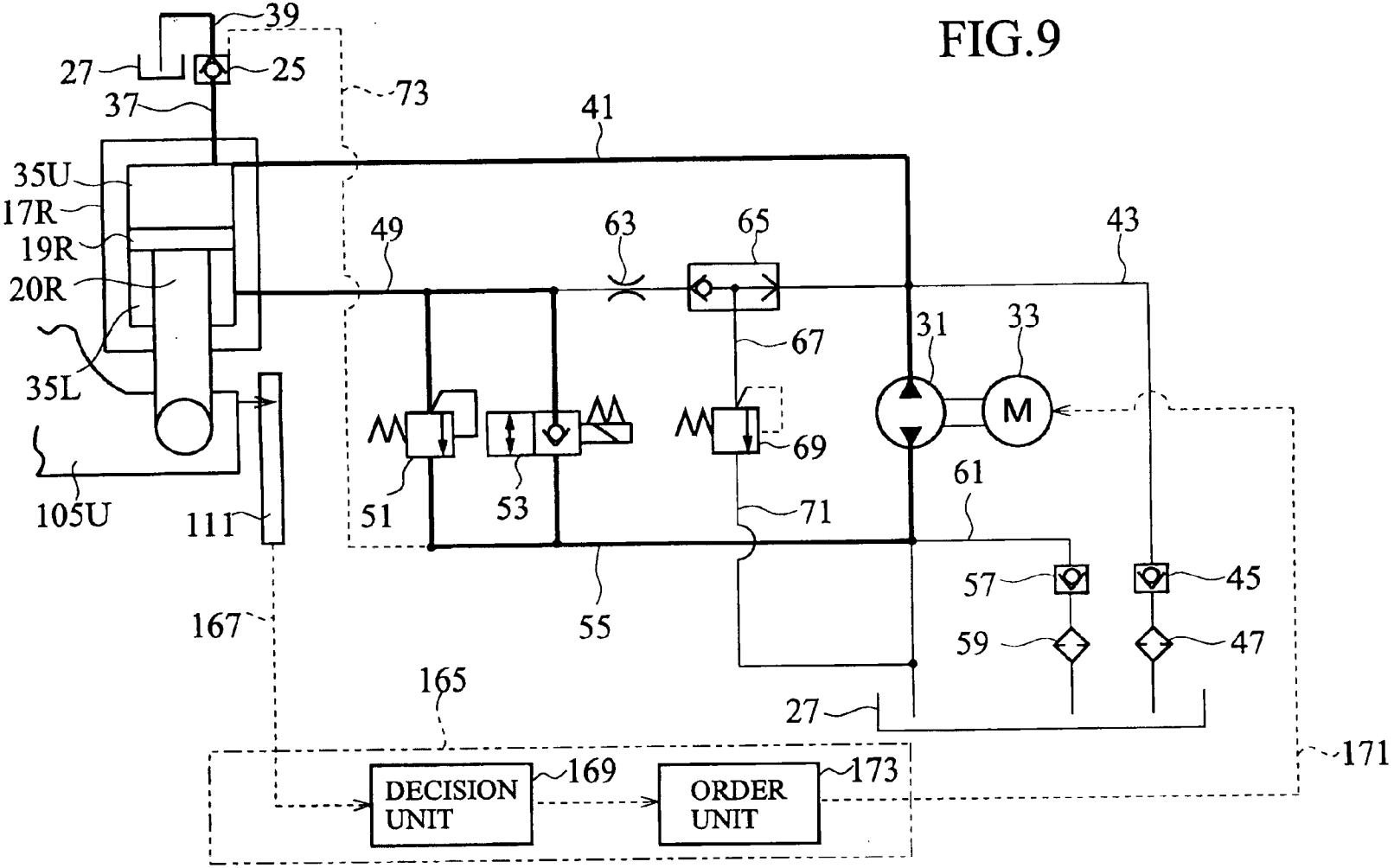
FIG. 9 is a circuit diagram showing a hydraulic circuit of a press brake according to another embodiment of this invention.

In the case of further moving downward so as to perform the bending work, the sequence switch valve 53 is set to a state shown in FIG. 9, and the working fluid from the lower cylinder chamber 35L is returned to the two-way piston pump 31 through the piping 49, the counter balance valve 51 and the piping 55, and is supplied to the upper cylinder chamber 35U of the hydraulic cylinder 17R from the piping 41. Accordingly, the piston 19R moves downward and the upper table 105U moves downward, thereby performing the bending work.

In this case, since a cross sectional area in a lower surface side of the piston 19R is smaller than an upper surface side, an amount of the working fluid returning to the two-way piston pump 31 from the lower cylinder chamber 35L is less than an amount of the working fluid charged into the upper cylinder chamber 35U, so that the working fluid is refilled from the oil tank 27 via the check valve 57.

On the contrary, in the case that the determination unit 169 of the control apparatus 165 determines on the basis of the position signal 167 of the upper table 105U applied from the linear scale 111 that the bending work is finished, thereby moving the upper table 105U upward, the switch valve 53 is switched to a state shown in FIG. 9, the AC servo motor 33 is rotated in an opposite direction to that of the case mentioned above on the basis of a reverse rotation order from the order unit 173 so as to reverse rotate the two-way piston pump 31, and supply the working fluid from the upper cylinder chamber 35U in a state in which the piston 19R moves downward to the lower cylinder chamber 35L through the piping 41, the two-way piston pump 31, the piping 55, the switch valve 53, the piping 49 and the like. Accordingly, the piston 19R moves upward and the upper table 105U moves upward.

In this case, when a pressure of the working fluid charged into the lower cylinder chamber 35L becomes higher than a predetermined value, the prefill valve 25 is opened according to a pilot signal 73, and the working fluid is fed to the oil tank 27 from the upper cylinder chamber 35U through the prefill valve 25.

As a result of the above, since the vertical movement of the piston 19R of the hydraulic cylinder 17R is switched by reversing the rotation of the two-way piston pump 31 on the basis of the control of the AC servo motor 33 having a strong driving force, it is possible to reduce the shock at a time of depressure which is generated at a time of employing the conventional switch valve, and it is possible to increase the ram speed at a time of depressure. Accordingly, it is possible to improve a productivity.

Further, since no switch valve for switching the vertical movement of the piston 19R is provided, it is possible to prevent the vibration conventionally generated by the switch valve from being generated. Further, since the flow rate property is not affected by the pressure, a motion gain of the ram is not changed so much, and it is possible to prevent the vibration generated by the change of flow rate property with respect to the pressure.

In this case, the present invention is not limited to the embodiments mentioned above, and can be achieved by the other aspects by suitably modifying. That is, in the embodiments mentioned above, the description is given of the press brake 101 moving the upper table 105U upward and downward, however, the absolute same matter can be applied to a press brake moving the lower table 105L upward and downward.

It is claimed:

1. A press brake comprising a plurality of hydraulic cylinders that move at least one of an upper table and a lower table relative to each other vertically, wherein respective individually controllable two-way fluid pumps that are provided in correspondence to the respective hydraulic cylinders are connected via individually controllable hydraulic devices.

2. A press brake as claimed in claim 1, wherein the respective individually controllable hydraulic cylinders include an upper portion, the hydraulic devices connecting the respective two-way fluid pumps each include an upper side, a base plate is mounted to the upper portion of the respective hydraulic cylinders, the respective hydraulic devices are attached to the base plate, and an oil tank is provided in the upper side of the hydraulic devices.

3. A press brake comprising a plurality of hydraulic cylinders for moving a ram vertically, the press brake comprising:

a plurality of two-way fluid pumps respectively corresponding to the plurality of hydraulic cylinders and connected to upper cylinder chambers and lower cylinder chambers of the hydraulic cylinders;

a servo motor that drives the respective two-way fluid pumps so as to supply a working fluid to at least one of the upper cylinder chambers and the lower cylinder chambers;

a position detector that detects a vertical position of the ram; and a control device that controls the servo motor, the control device comprising:

a determiner that determines whether a bending work has been finished based on a signal from the position detector; and an order unit that orders the servo motor to reverse rotate so as to reverse the two-way fluid pumps when the determiner determines that the bending work is finished.

4. A ram moving method in a press brake provided with a plurality of hydraulic cylinders, comprising:

rotating two-way fluid pumps connected to upper cylinder chambers and lower cylinder chambers of the hydraulic cylinders, using a servo motor;

supplying a working fluid to one of the upper cylinder chambers and the lower cylinder chambers in the respective hydraulic cylinders so as to move the ram vertically;

detecting a vertical position of the ram so as to determine whether the bending work has been finished based on the detected ram position; and reversing the servo motor when it is determined that the bending work is finished, thereby reversing the two-way fluid pump so as to supply the working fluid supplied to the one cylinder chamber to another cylinder chamber and thereby move the ram vertically.

5. A press brake comprising:

a frame;

a first table freely moving vertically;

a second table moving relative to the first table so as to approach to and separate from the first table;

a left hydraulic cylinder provided in a left side of the frame to move the first table vertically;

a first two-way fluid pump connected to an upper cylinder chamber and a lower cylinder chamber of the left hydraulic cylinder, the first two-way fluid pump discharging a working fluid in a normal flow direction and a reverse flow direction to operate the left hydraulic cylinder in a vertical direction;

a first servo motor that rotates the first two-way fluid pump in a normal rotation direction and a reverse rotation direction;

a first control apparatus that controls the first servo motor;

a right hydraulic cylinder provided in a right side of the frame to move the first table vertically;

a second two-way fluid pump connected to an upper cylinder chamber and a lower cylinder chamber of the right hydraulic cylinder, the second two-way fluid pump discharging the working fluid in the normal flow direction and the reverse flow direction to operate the right hydraulic cylinder in the vertical direction;

a second servo motor that rotates the second two-way fluid pump in the normal rotation direction and the reverse rotation direction; and a second control apparatus that controls the second servo motor independently of the first servo motor.

6. A press brake as claimed in claim 5, further comprising:

a first position detector that measures a position with respect to the second table at a left side of the first table; and a second position detector that measures a position with respect to the second table at a right side of the first table, wherein the first control apparatus is provided with a determiner that determines whether a bending work is finished based on a signal from the first position detector, and an order unit that orders the first servo motor to reverse rotate so as to reverse the first two-way fluid pump when the determiner determines that the bending work is finished; and wherein the second control apparatus is provided with a determiner that determines whether the bending work has been finished based on a signal from the second position detector, and an order unit that orders the second servo motor to reverse rotate so as to reverse the second two-way fluid pump when the determiner determines that the bending work has been finished.

7. A press brake as claimed in claim 6, wherein the first two-way fluid pump is connected to the left hydraulic cylinder via a first hydraulic device;

the second two-way fluid pump is connected to the right hydraulic cylinder via a second hydraulic device;

the first hydraulic device and the first two-way fluid pump are located in the left hydraulic cylinder; and the second hydraulic device and the second two-way fluid pump are located in the right hydraulic cylinder.

8. A ram moving method in a press brake comprising:

rotating a first two-way fluid pump that is connected to an upper cylinder chamber and a lower cylinder chamber of a left hydraulic cylinder, using a first servo motor;

supplying a working fluid to one of the upper cylinder chamber and the lower cylinder chamber in the left hydraulic cylinder so as to move a first table towards a second table;

detecting a vertical position of the first table with respect to the second table, using a first position detector;

determining whether a bending work is finished based on a position of the first table detected by a first control apparatus;

supplying the working fluid supplied to the one cylinder chamber in the left hydraulic cylinder to another cylinder chamber and thereby moving a left portion of the first table further from the second table, in accordance with the first control apparatus reverse rotating the first servo motor to thereby reverse the first two-way fluid pump, when it is determined that the bending work has been finished;

rotating a second two-way fluid pump that is connected to an upper cylinder chamber and a lower cylinder chamber of a right hydraulic cylinder, using a second servo motor;

supplying the working fluid to one of the upper cylinder chamber and the lower cylinder chamber in the right hydraulic cylinder so as to move the first table towards the second table;

detecting the vertical position of the first table with respect to the second table, using a second position detector;

determining whether the bending work has been finished, based on a position of the first table detected by a second control apparatus; and supplying the working fluid supplied to the one cylinder chamber in the right hydraulic cylinder to another cylinder chamber and thereby moving a right portion of the first table further from the second table, in accordance with the second control apparatus reverse rotating the second servo motor to thereby reverse rotate the second two-way fluid pump, when it is determined that the bending work has been finished, wherein the first control apparatus and the second control apparatus respectively control the first servo motor and the second servo motor in an independent manner.

9. A press brake as claimed in claim 1, wherein the respective individually controllable hydraulic cylinders include an upper portion, the hydraulic devices connecting the respective two-way fluid pumps each include an upper side, and a base plate is mounted to the upper portion of the respective hydraulic cylinders, the respective hydraulic devices are attached to the base plate, and an oil tank is provided in the upper side of the hydraulic devices.

10. A press brake as claimed in claim 1, further comprising:

a crowning cylinder provided in a center portion of the lower table so as to facilitate vertical positioning of a die that is provided in an upper end portion of the lower table; and a two-way fluid pump configured so as to be connected via a hydraulic device in correspondence to the crowning cylinder.

* * * * *

UNITED STATES PATENT AND TRADEMARK OFFICE

CERTIFICATE OF CORRECTION

PATENT NO. : 6,959,581 B2
APPLICATION NO. : 10/110210
DATED : November 1, 2005
INVENTOR(S) : K. Kanno It is certified that error appears in the above-identified patent and that said Letters Patent is hereby corrected as shown below:

On the cover page, the 371 (c)(1),(2),(4) Date should be --April 18, 2002--.

On the cover page, at Item (57), Abstract, line 7, after "two-way" delete " . ".

On the cover page, at Item (57), Abstract, line 9, after "(17L, 17R)" insert -- . --.

Signed and Sealed this

Eleventh Day of July, 2006

JON W. DUDAS
*Director of the United States Patent and Trademark Office*